US006056030A

United States Patent [19]

Jonkka

[11] Patent Number: 6,056,030

[45] Date of Patent: May 2, 2000

[54] BLADE DISK ARRANGEMENT FOR A DISK CHIPPER AND A HINGE STRIP OF A WEAR PLATE

[75] Inventor: Arvo Jonkka, Pori, Finland

[73] Assignee: Sunds Defibrator Woodhandling Oy, Pori, Finland

[21] Appl. No.: 09/214,425

[22] PCT Filed: Jul. 1, 1997

[86] PCT No.: PCT/FI97/00425

§ 371 Date: Jan. 6, 1999

§ 102(e) Date: Jan. 6, 1999

[87] PCT Pub. No.: WO98/01272

PCT Pub. Date: Jan. 15, 1998

[30] Foreign Application Priority Data

Jul. 10, 1996 [FI] Finland ..... 962808

[51] Int. Cl.[7] ..... B27C 7/10; B02C 18/18

[52] U.S. Cl. ..... 144/176; 144/162.1; 144/373; 241/92; 241/292.1; 241/298

[58] Field of Search ..... 144/162.1, 176, 144/373; 241/92, 292, 292.1, 298

[56] References Cited

U.S. PATENT DOCUMENTS

| | | | |
|---|---|---|---|
| 4,503,893 | 3/1985 | Demopoulos . | |
| 4,685,497 | 8/1987 | Mierau et al. | 144/176 |
| 5,129,437 | 7/1992 | Nettles et al. | 144/176 |
| 5,287,901 | 2/1994 | Matthews . | |
| 5,857,508 | 1/1999 | Jonkka | 144/176 |

FOREIGN PATENT DOCUMENTS

| | | |
|---|---|---|
| 79799 | 11/1989 | Finland . |
| WO90/15702 | 12/1990 | WIPO . |

*Primary Examiner*—W. Donald Bray
*Attorney, Agent, or Firm*—Burns, Doane, Swecker & Mathis, L.L.P.

[57] ABSTRACT

The invention concerns a knife disc arrangement of a disc chipper, said arrangement comprising a rotating knife disc (1), knives (3), wear plates (4) and supporting strips (11) supporting the wear plates. The invention also concerns a hinge strip acting as a supporting strip (11) for the wear plate. The knives are supported against the direction of rotation of the disc by fitting the base edge (9) of the knife against a supporting surface (10). The supporting surface (10) supporting the base edge of the knife (3) is located in the supporting strip (11).

3 Claims, 3 Drawing Sheets

PRIOR ART

PRIOR ART

BLADE DISK ARRANGEMENT FOR A DISK CHIPPER AND A HINGE STRIP OF A WEAR PLATE

Figure 1:
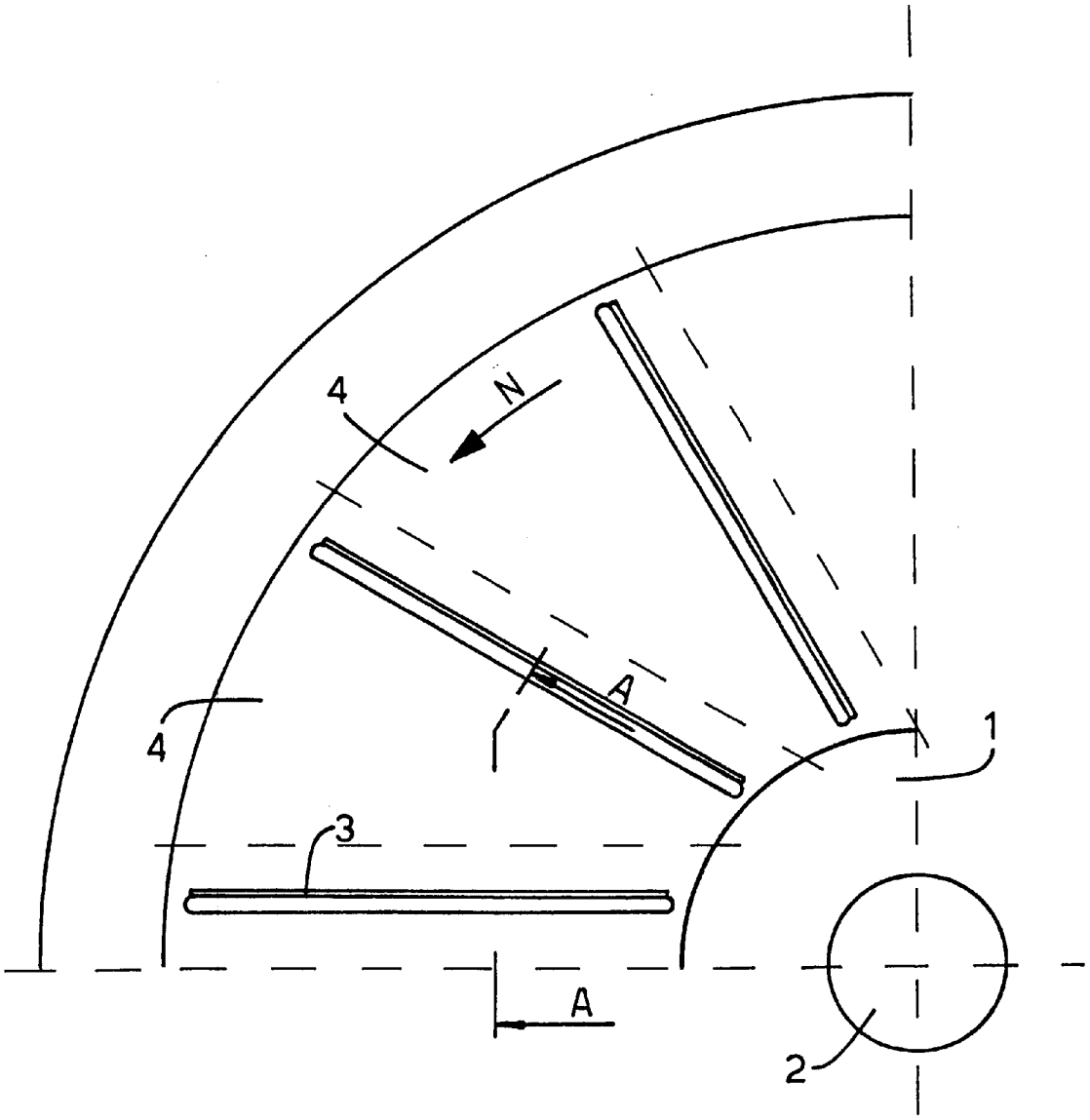

The present invention concerns a knife disc arrangement of a disc chipper, whereby several knives are mounted on a rotating knife disc, said knives extending from the center portion of the disc towards the outer edge of the disc, and wear plates are mounted on the sectors between the knives, and whereby the knives are supported against the rotating direction of the disc by arranging the base edge of the knife against a supporting surface, and the wear plate is supported in its position by means of a supporting strip fastened to the disc. The invention also concerns a hinge strip of a wear plate of a disc chipper, said hinge strip supporting the wear plate of the disc chipper in its position and having a counter surface for supporting the wear plate and being shaped as a part of a cylindrical surface.

The invention concerns manufacturing and construction of a wear plate for a disc chipper generally used.

Wear plates consisting of a massive solid part in a sector between two sequential knives are generally used in traditional, old disc chippers. This kind of a wear plate is described, e.g., in patent publication FI 79799. Wear plates are usually provided with a hard plating sintered on the wearing surface after the basic machining. The wear plates have, in addition, a prominent projecting part for maintaining the plate in position when the chipping forces tend to move it. Due to the aforementioned facts, the plates must be manufactured of thick plate blanks, a considerable part of which will be removed by machining. The massive material as well as the machining, sintering and the second machining phase after the heat treatment make the wear plate expensive and a slow part to produce.

A knife disc arrangement according to the present invention is characterized in that the supporting surface supporting the base edge of the knife is located in said strip, by means of which the wear plate is supported in its position. A hinge strip of the wear plate in accordance with the invention is characterized in that the hinge strip has a projecting part which can be fitted against a groove in the knife disc and which has a supporting surface, against which the base edge of the knife can be fitted.

By means of the present invention, the characteristics of a wear plate are improved and, simultaneously, the production costs of the wear plate are decreased. In the construction according to the invention, a strip is mounted under a separate, evenly thick wear plate, said strip keeping the wear plate in the right position, forming thus the supporting surface of the knife and being supported by the supporting surface of a groove in the knife disc and forming an adjustable hinge of the wear plate.

A wear plate according to the invention can be made of hard, temper hardened steel, over 300 Hb, having a high yield point and being difficult to machine.

The arrangement can be used for spare part deliveries for existing, old knife discs, where the groove required by the arrangement already exists in the knife disc.

Figure 2:
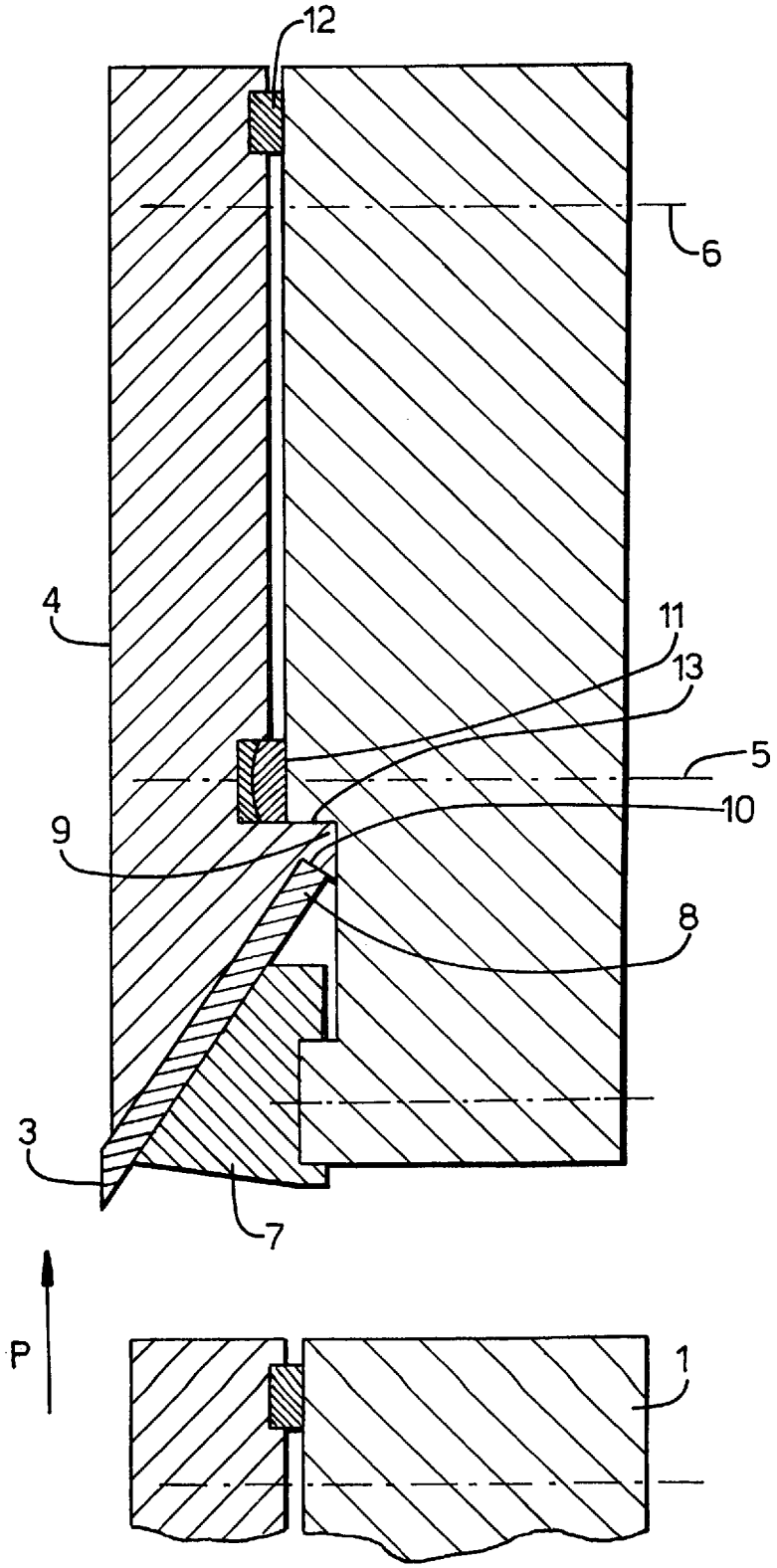
Figure 3:
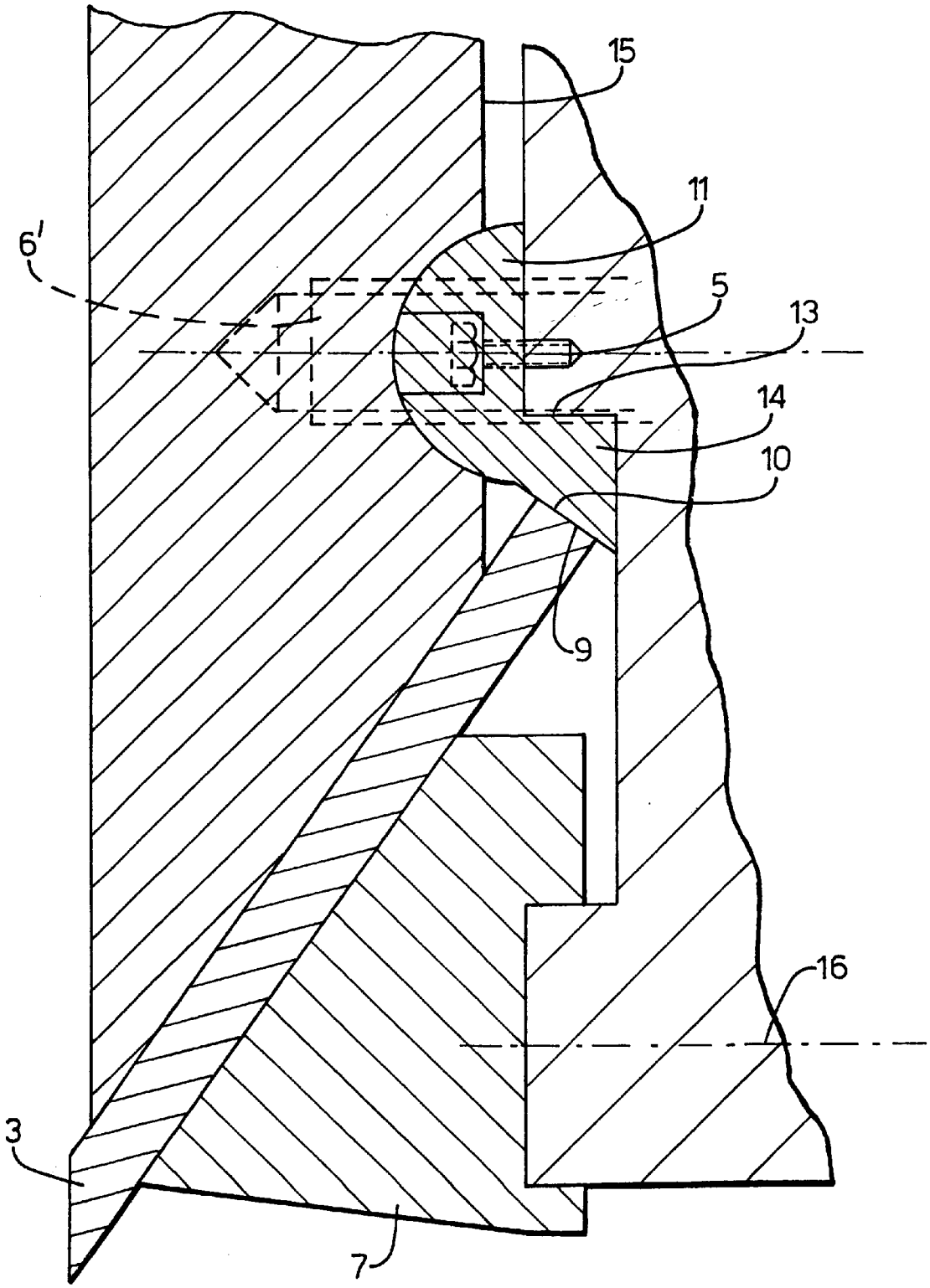

The invention and its details will be described in more detail in the following, with reference to the enclosed drawings, wherein FIG. 1 illustrates one quarter of a chipper disc, viewed from the cutting side, FIG. 2 illustrates a prior art wear plate provided with a hinge joint, as section A—A of FIG. 1, in a larger scale, FIG. 3 illustrates a wear plate and a hinge strip in accordance with the invention.

The body 1 of the chipper's knife disc is mounted on a rotating shaft 2. Arrow N shows the disc's direction of rotation in FIG. 1. Several knives 3 are mounted on the disc and extend from the central part of the disc towards the outer periphery of the disc. The knives have straight cutting edge lines all in the same plane, perpendicular to the disc shaft. The direction of the knives may differ from the radial direction so that the outer ends of the knives will move foremost or rearmost as the disc is rotating. The sectors between the knives are covered in major part with inclined wear plates 4, fastened to the knife disc by means of bolts 5 and 6 (FIG. 2).

The knife is supported between the wear plate and a knife base 7 so that the base edge 8 of the knife leans against the supporting surface 10 of a shoulder 9 in the wear plate. For adjusting the length of the chips, the wear plate can be turned so that the distance of its rear edge from the leading edge of the next wear plate changes. The wear plate can be turned by means of a hinge strip 11 and a supporting strip 12.

When the counter knife prevents a log of wood from moving in the radial direction of the log, the log applies a force in direction P (FIG. 2) to the knife 3 and via the knife to the shoulder 9 in the wear plate. During the chipping, the force P applied to the knife armature tends to move the knife armature in the direction of P. This is prevented when the shoulder 9 in the wear plate is supported against a supporting surface 13 of a groove in the knife disc.

In a construction (FIG. 3) in accordance with the invention, the shoulder 9 in the wear plate has been replaced by a shoulder 14 provided in the hinge strip 11, and the base edge 9 is supported against a supporting surface 10 of the shoulder. The shoulder 14 is supported against a supporting surface 13 of a groove in the knife disc. The hinge strip is fastened to the knife disc 1 by means of screws 5. In addition to the screws 5, there are screws 6' going through the hinge strip and extending from the rear surface of the knife disc to the wear plate.

In a construction in accordance with the invention, the chipping forces in the direction P are not applied to the wear plate via the knife 3, but to the supporting surface 13 of the groove in the knife disc, via the shoulder 14 of the hinge 11. The hinge 11 of the adjustable wear plate thus forms the supporting surface for the knife 3. The hinge aligns and simultaneously keeps the wear plate in the right position on the surface of the knife disc 1. The hinge strip is fastened against the knife disc by means of the screws 5 and 6', and the wear plate 4 is pressed against the hinge strip by the fastening force of the bolts 6'.

When the shoulder is omitted in the wear plate 4, it can be manufactured of a thinner blank. Further, the inner surface 15 of the wear plate need not be machined. Thus, the wear plate according to the invention does not require a lot of machining work, and it can be manufactured of a hard wear plate, whereby the hard plating of the wear plate can be omitted. Thereby it is possible to manufacture a wear plate, in which the yield limit of the basic material is from twofold to threefold compared with the traditional one, and the pressing force of the knives 3 can be increased by means of the knife base 7 and the knife bolts 16.

The invention is not restricted to the above described embodiments only, but it may vary in different ways within the scope of the enclosed claims.

The supporting strip I1, in which the supporting surface supporting the base edge of the knife is located, does not necessarily have to be a hinge strip, by means of which the position of the wear plate is adjusted.

I claim:

1. A knife disc arrangement of a disc chipper, comprising:

a plurality of knives;

a rotating knife disc on which the knives are mounted the knives extending from a center portion of the disc toward an outer edge of the disc;

wear plates mounted on the disc between the knives;

a base edge of each knife being arranged against a supporting surface of the wear plates to support the knives against a rotating direction of the disc; and the wear plates being supported relative to the disc by a supporting strip fastened to the disc, the supporting surface being located in the supporting strip.

2. An arrangement in accordance with claim 1, wherein the supoorting strip is a hinge strip and has a counter surface for supporting the wear plates, the counter surface being shaped as a part of a cylinder surface and permitting turning of the wear plates about a center axis of the cylindrical surface.

3. A hinge strip for supporting a wear plate of a disc chipper, the hinge strip comprising a counter surface for supporting a wear plate, the counter surface being shaped as a part of a cylindrical surface; and a projection connected to the counter surface the projection being fittable against a groove in a knife disc having a supporting surface against which a base edge of a knife is fittable.

* * * * *